US006176684B1

(12) United States Patent
Zimmermann

(10) Patent No.: US 6,176,684 B1
(45) Date of Patent: Jan. 23, 2001

(54) VARIABLE DISPLACEMENT HYDRAULIC PISTON UNIT WITH ELECTRICALLY OPERATED VARIABLE DISPLACEMENT CONTROL AND TIMING CONTROL

(75) Inventor: Daniel E. Zimmermann, Peoria, IL (US)

(73) Assignee: Caterpillar Inc., Peoria, IL (US)

( * ) Notice: Under 35 U.S.C. 154(b), the term of this patent shall be extended for 0 days.

(21) Appl. No.: 09/201,444

(22) Filed: Nov. 30, 1998

(51) Int. Cl.[7] ..... F04B 1/26
(52) U.S. Cl. ..... 417/222.1; 92/71
(58) Field of Search ..... 417/222.1, 269, 417/270; 92/71

(56) References Cited

U.S. PATENT DOCUMENTS

| | | | | |
|---|---|---|---|---|
| 3,365,886 | * | 1/1968 | Moon, Jr. | 60/53 |
| 3,803,843 | * | 4/1974 | Nyman et al. | 60/19 |
| 3,941,514 | * | 3/1976 | Louis et al. | 417/216 |
| 4,353,174 | | 10/1982 | Maloblocki | 37/58 |
| 4,381,702 | | 5/1983 | Myers | 91/506 |
| 5,064,351 | * | 11/1991 | Hamey et al. | 417/222 R |
| 5,213,083 | | 5/1993 | Glassey | 123/447 |
| 5,295,796 | | 3/1994 | Goto et al. | 417/222.1 |
| 5,344,288 | * | 9/1994 | Oda | 417/218 |
| 5,471,959 | | 12/1995 | Sturman | 123/447 |
| 5,515,768 | | 5/1996 | Fritz et al. | 92/71 |
| 5,515,829 | | 5/1996 | Wear et al. | 123/446 |
| 5,531,190 | | 7/1996 | Mork | 123/41.12 |
| 5,564,905 | | 10/1996 | Manring | 417/222.1 |
| 5,630,707 | | 5/1997 | Kim et al. | 417/269 |
| 5,683,228 | | 11/1997 | Beatty | 417/269 |
| 5,868,555 | * | 2/1999 | Shimotomai | 417/222.1 |

* cited by examiner

*Primary Examiner*—Noah P. Kamen
*Assistant Examiner*—Mahmoud M Gimie
(74) *Attorney, Agent, or Firm*—Haverstock, Garrett & Roberts; J. W. Burrows

(57) ABSTRACT

A variable displacement hydraulic piston unit with electrically operated variable displacement control and timing control is disclosed, the displacement control utilizing an electric motor such as a stepper motor and cam arrangement operable for changing the tilt angle of a swash plate of the unit, and the timing control including an electric motor, such as a stepper motor operable for rotating the swash plate relative to the pistons of the unit for effecting timing changes, the unit being operable as a pump, motor, or the like.

12 Claims, 3 Drawing Sheets

VARIABLE DISPLACEMENT HYDRAULIC PISTON UNIT WITH ELECTRICALLY OPERATED VARIABLE DISPLACEMENT CONTROL AND TIMING CONTROL

TECHNICAL FIELD

This invention relates generally to variable displacement hydraulic piston units such as pumps, motors, and the like, and more particularly, to a hydraulic piston unit having a displacement control including an electric motor, such as a stepper motor and cam arrangement operable for changing swash plate angle, and a timing control operable using a stepper motor for rotating the swash plate.

BACKGROUND ART

Currently, variable displacement hydraulic piston units, such as pumps, motors and the like, typically utilize a hydraulic or electro-hydraulic system for changing swash plate angle for varying displacement. It is also known to vary timing by changing the angular position of the port plate of a unit using various means, including a stepper motor and gear arrangement.

However, the typical known hydraulic valves utilized for controlling displacement are generally complex and expensive. It is also desirable to have an alternative to changing port plate position for varying timing. Still further, with the trend toward increased electronic control of hydraulic systems, it is desirable to integrate hydraulic piston unit displacement and timing in an electronic format with other electronically controlled functions.

Accordingly, the present invention is directed to overcoming one or more of the problems as set forth above.

DISCLOSURE OF THE INVENTION

In one aspect of the present invention, a variable displacement hydraulic piston unit with variable timing is disclosed. The piston unit includes a port plate including a flat surface having an axis therethrough and an intake port and an exhaust port at angularly spaced locations around the axis. The piston unit includes a cylinder barrel and structure supporting the cylinder barrel for rotation about the axis relative to the port plate, the cylinder barrel having a first axial end portion in abutment with the surface of the port plate, and an opposite second axial end portion. A plurality of axial piston bores extends through the cylinder barrel between the axial end portions in circumferentially spaced relation around the axis, the bores being positioned to sequentially open into the intake port and the exhaust port during the rotation of the cylinder barrel. The unit includes a plurality of pistons positioned for axial displacement in the respective piston bores in timed relation to the intake port and the exhaust port during the rotation of the cylinder barrel, and a swash plate and structure supporting the swash plate adjacent the second axial end portion of the cylinder barrel for sliding contact with the pistons during the rotation of the cylinder barrel. The structure supporting the swash plate is adapted for allowing tilting of the swash plate relative to the cylinder barrel about a tilt axis orientated crosswise to the first named axis for varying the displacement of the pistons, and is adapted for allowing rotation of the swash plate about the first named axis for varying the timed relation of the displacement of the pistons to the intake port and the exhaust port.

According to a preferred aspect of the invention, the swash plate and the structure supporting the swash plate are jointly rotatable about the first named axis for varying the timed relation of the displacement of the pistons to the intake port and the exhaust port using an electric motor, such as a stepper motor and a drive.

In another aspect of the invention, the structure supporting the swash plate includes an electric motor, such as a stepper motor operable for controllably tilting the swash plate about the tilt axis for varying the displacement of the pistons.

BRIEF DESCRIPTION OF THE DRAWINGS

For a better understanding of the present invention, reference may be made to the accompanying drawings in which.

BEST MODE FOR CARRYING OUT THE INVENTION

Figure 1:
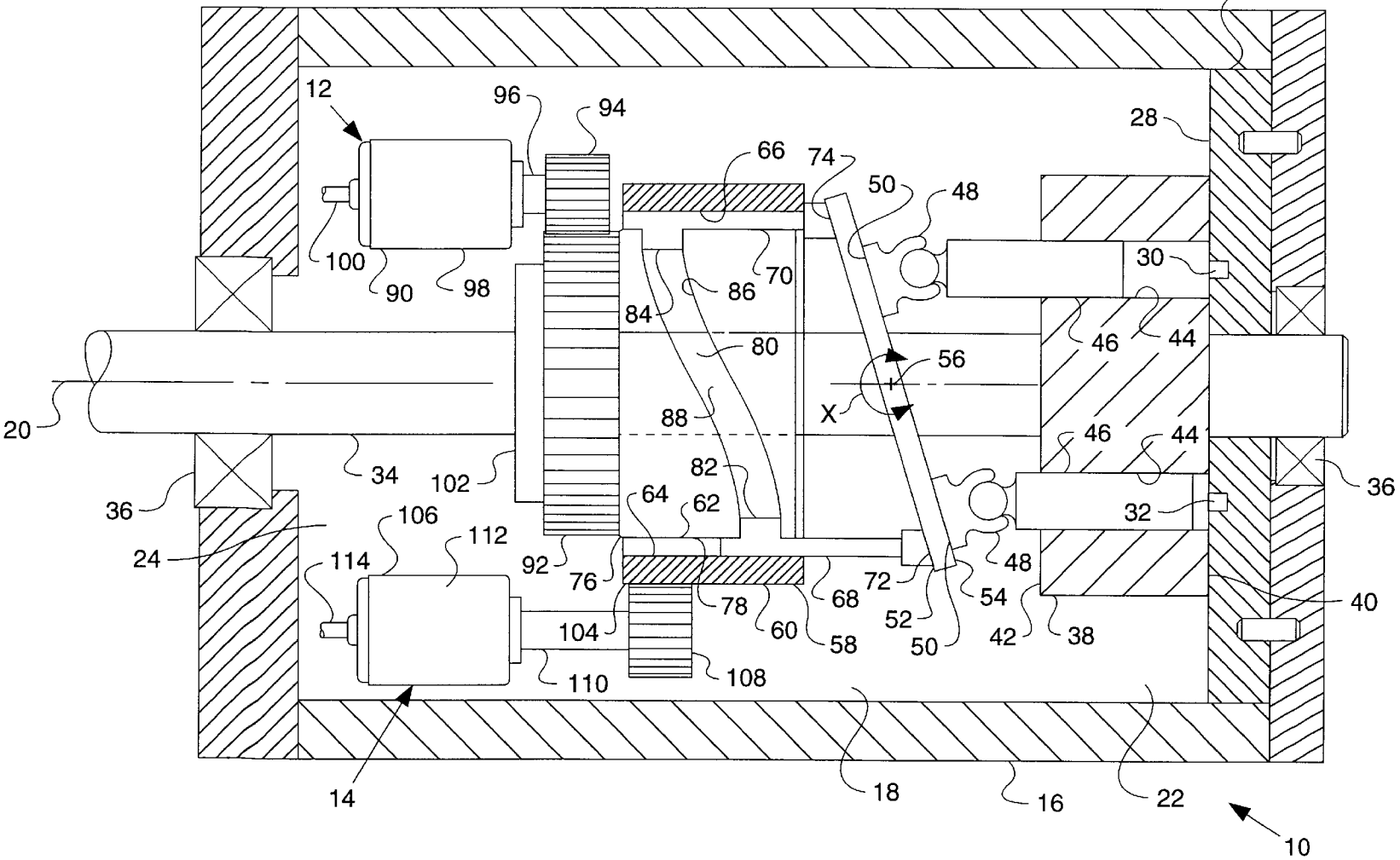
FIG. 1 is a schematic representation of a hydraulic piston unit including electrically operable displacement and timing controls according to the present invention, the displacement control being shown positioning a swash plate of the unit in a first representative displacement position, and the timing control being shown positioning the swash plate at a first timing position.
Figure 2:
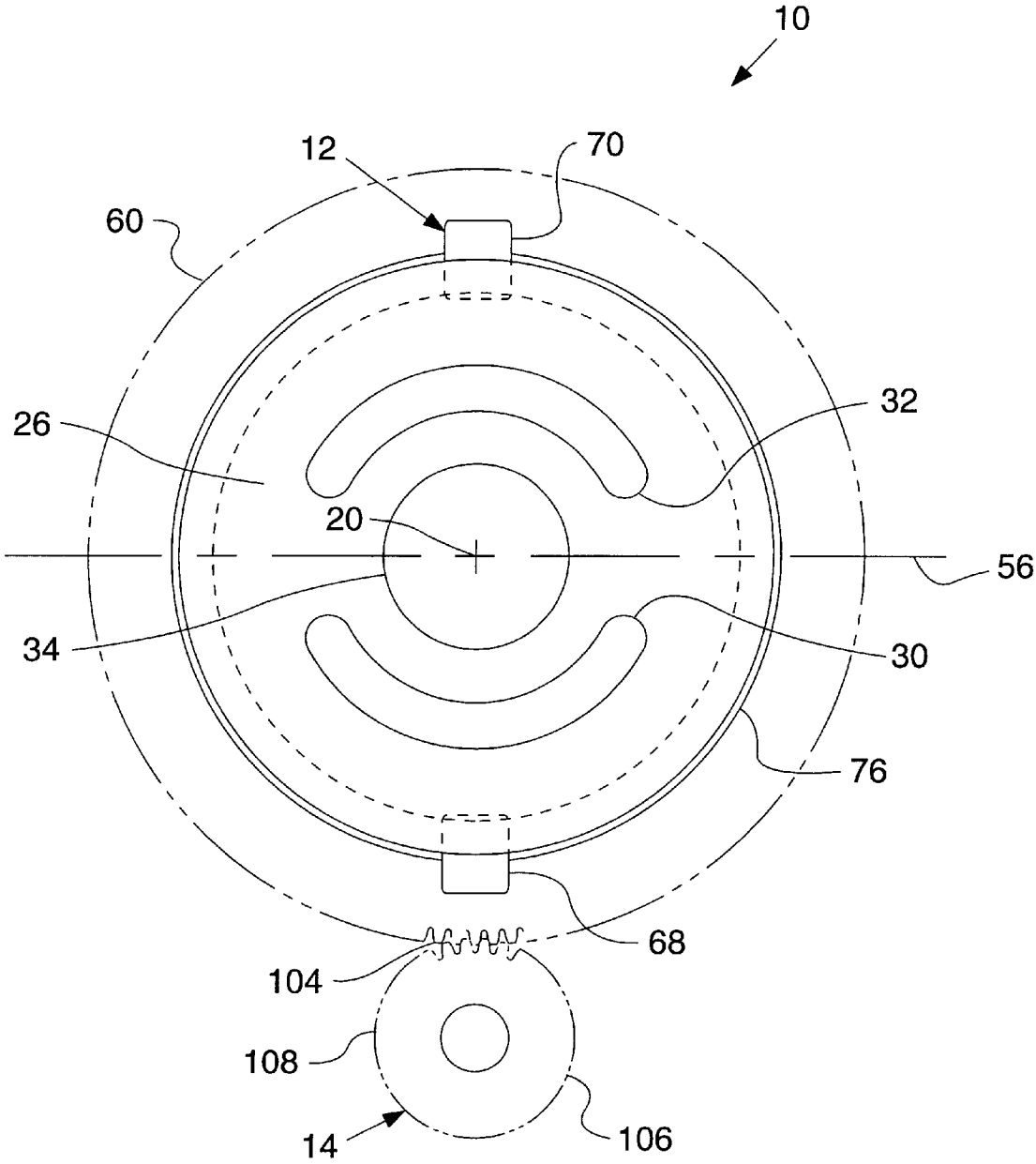
FIG. 2 is a schematic end view of the unit of FIG. 1, showing the timing control with the swash plate at the first timing position.

Referring now to the drawings, wherein a preferred embodiment of the present invention is shown, FIGS. 1 and 2 are schematic representations of a variable displacement hydraulic piston unit 10 including a displacement control 12 and a timing control 14 constructed and operable according to the teachings of the present invention. Variable displacement piston unit 10 is a hydraulic pump unit including a generally cylindrical shaped housing 16 defining a cavity 18. A longitudinal axis 20 extends through cavity 18 between a pump end 22 and a control end 24. A port plate 26 is located in pump end 22, and includes a flat surface 28 through which axis 20 extends. Port plate 26 further includes an arcuate shape intake port 30 and an arcuate shape exhaust port 32 in surface 28 at angularly spaced locations around axis 20. Intake port 30 is adapted for connection in fluid communication with an intake passage (not shown) for receiving fluid therefrom, and exhaust port 32 is adapted for connection in fluid communication with an exhaust passage (also not shown) for exhausting fluid thereto, in the conventional manner. A pump drive shaft 34 is mounted to housing 16 by bearings 36 for rotation in cavity 18 about axis 20. A cylinder barrel 38 is mounted to shaft 34 for rotation therewith about axis 20. Cylinder barrel 38 includes a first axial end portion 40 located in abutment with surface 28 of port plate 26, and an opposite second axial end portion 42. A plurality of axial piston bores 44 extend through cylinder barrel 38 between axial end portions 40 and 42 in circumferentially spaced relation around axis 20 so as to sequentially open into intake port 30 and exhaust port 32 of port plate 26 during the rotation of cylinder barrel 38.

A plurality of pistons 46 are positioned for axial displacement in the respective axial piston bores 44 in timed relation to intake port 30 and exhaust port 32 during the rotation of cylinder barrel 38. Each piston 46 includes a pivotally mounted shoe 48 having a flat surface 50 on the end thereof opposite port plate 26.

Piston unit 10 further includes a swash plate 52 having a generally flat surface 54 and structure (not shown) for maintaining flat surface 54 in sliding engagement with flat surfaces 50 of pistons 46 during the rotation of pistons 46 with cylinder barrel 38. Swash plate 52 is tiltable about a tilt axis 56 while engaged with shoes 48 of pistons 46 to enable fluid to be drawn into piston bores 44 when in communication with inlet port 30, and the fluid to be exhausted from piston bores 44 into exhaust port 32 when in communication therewith.

Displacement control 12 includes structure 58 supporting swash plate 52 at desired tilt angles about tilt axis 56 for providing a desired displacement of pistons 46. Structure 58 includes an outer tubular member 60 concentric about axis 20 and including an inner annular surface 62 having a pair of axially extending, diametrically opposed guide slots 64 and 66 therein. Structure 58 includes a pair of cam followers 68 and 70 positioned for axial movement in respective slots 64 and 66, cam followers 68 and 70 pivotally supporting swash plate 52 at diametrically opposed locations 72 and 74 with respect to axis 20. Cam followers 68 and 70 are axially moveable for changing the angle of swash plate 52 about tilt angle 56 by a cylindrical cam 76 including an outer circumferential surface 78 having a generally helical, circumferentially extending cam slot 80 therein which cooperatively receives radially inwardly extending follower portions 82 and 84 of respective cam followers 68 and 70. Cam 76 includes axially opposed cam surfaces 86 and 88 in cam slot 80 and engageable with follower portion 82 and follower portion 84 for supporting cam followers 68 and 70 and swash plate 52. Cylindrical cam 76 is controllably rotatable about axis 20 relative to tubular member 60 and cam followers 68 and 70 by a drive assembly 90.

Drive assembly 90 includes a gear 92 concentric about axis 20 and mounted in driving relation to cylindrical cam 76, a drive gear 94 enmeshed with gear 92, drive gear 94 being mounted to an output shaft 96 of an electric motor, such as a stepper motor 98. Stepper motor 98 is of conventional construction and operation, operable using a voltage signal received via wire 100 connected in electrical communication between stepper motor 98 and a selectively operable power source such as a conventional direct current (DC) motor controller or the like (not shown) to rotate swash plate 52 as denoted by the arrow X to a desired angle with respect to axis 20 and hold it at the angle. It is recognized that a servo motor or other types of electric motors could be used in place of the stepper motor 98.

Displacement control 12 further includes a thrust bearing 102 mounted for rotation about pump drive shaft 34 for maintaining cylindrical cam 76 in desired axial relation to swash plate 52.

Timing control 14 includes an external gear 104 extending circumferentially around at least a portion of tubular member 60, and a drive assembly 106 including a drive gear 108 enmeshed with gear 104 mounted on an output shaft 110 of an electric motor, such as a stepper motor 112. Stepper motor 112 is of conventional construction and operation controllably operable using a voltage signal received over a wire 114 connecting stepper motor 112 in electrical communication with a power source such as a DC motor controller or the like (not shown). It is recognized that a servo motor or other types of electric motors could be used in place of the stepper motor 112.

Figure 3:
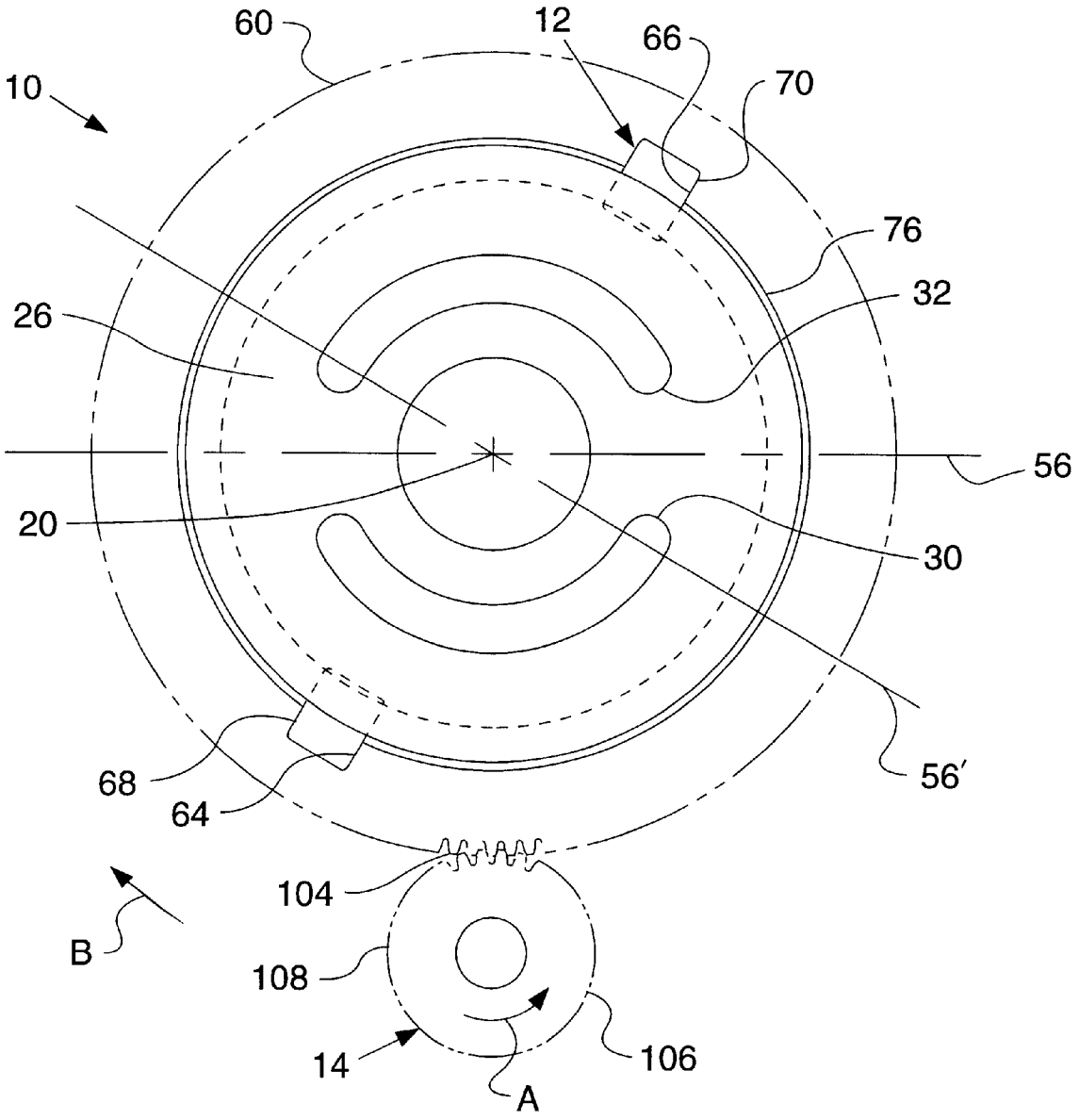
FIG. 3 is a schematic end view of the unit of FIG. 1, showing the timing control with the swash plate in a second timing position.

Referring also to FIG. 3, operation of timing control 14 will be discussed. More particularly, the angular position of tilt axis 56 about longitudinal axis 20 is shown for two respective timing positions providing different timed relations of the displacement of pistons 46 (FIG. 1) to intake port 30 and exhaust port 32 of port plate 26. In FIG. 2, tilt axis 56 is shown in the same angular position of FIG. 1 by the engagement of drive gear 108 of drive assembly 106 with gear 104 as shown. In FIG. 3, drive assembly 106 has been operated to rotate drive gear 108 counter clockwise as shown by the arrow A to rotate gear 104 clockwise as shown by the arrow B, which in turn rotates tilt axis 56 in the clockwise direction by the same amount as shown at 56', thereby effecting a change in the timed relation of the displacement of the pistons to intake port 30 and exhaust port 32 of port plate 26. Note here that, because in the preferred embodiment as explained above, gear 104 is mounted to tubular member 60 which carries cam followers 68 and 70 in slots 64 and 66 thereof, cylindrical cam 76 is likewise rotated with tubular member 60 so as to effect no undesired changes in the tilt angle of the swash plate.

INDUSTRIAL APPLICABILITY

The displacement control and timing control according to the present invention has utility for a wide variety of applications, including hydraulic piston units operated as pumps, motors, and both. In this regard, it is contemplated that displacement control 12 have sufficient capability to rotate swash plate 52 about tilt axis 56 for effecting positioning of swash plate 52 in an orientation for pumping, a neutral orientation, and an orientation for motor operation, as desired.

Other aspects, objects and advantages of the present invention can be obtained from a study of the drawings, the disclosure and the appended claims.

What is claimed is:

1. A variable displacement hydraulic piston unit with variable timing, comprising:

a port plate including a flat surface having an axis therethrough, an intake port and an exhaust port at angularly spaced locations around the axis;

a cylinder barrel and structure supporting the cylinder barrel for rotation about the axis relative to the port plate, the cylinder barrel having a first axial end portion in abutment with the surface of the port plate, an opposite second axial end portion, and a plurality of axial piston bores extending therethrough between the axial end portions in circumferentially spaced relation around the axis in position to sequentially open into the intake port and the exhaust port during the rotation of the cylinder barrel;

a plurality of pistons positioned for axial displacement in the respective piston bores in timed relation to the intake port and the exhaust port during the rotation of the cylinder barrel; and a swash plate and structure supporting the swash plate adjacent the second axial end portion of the cylinder barrel, the pistons being in sliding contact with the swash plate during the rotation of the cylinder barrel, the structure supporting the swash plate being operative to tilt the swash plate relative to the cylinder barrel about a tilt axis orientated crosswise to the first named axis to vary the displacement of the pistons, and the structure supporting the swash plate also being operative to rotate the swash plate about the first named axis to vary the timed relation of the displacement of the pistons relative to the intake port and the exhaust port.

2. The variable displacement hydraulic piston unit, as set forth in claim 1, wherein the swash plate and the structure supporting the swash plate are jointly rotatable about the first named axis to vary the timed relation of the displacement of the pistons to the intake port and the exhaust port.

3. The variable displacement hydraulic piston unit, as set forth in claim 2, including an electric motor and a drive operably connected to the structure supporting the swash plate to rotate the structure and the swash plate about the first named axis.

4. The variable displacement hydraulic piston unit, as set forth in claim 3, wherein the structure supporting the swash plate includes a cylindrical cam concentric with the first named axis and at least one cam follower cooperatively engaged with the cylindrical cam in supportive relation to the swash plate, the cylindrical cam and the at least one cam follower being relatively rotatable about the first named axis to effect the tilting of the swash plate about the tilt axis to vary the displacement of the pistons.

5. The variable displacement hydraulic piston unit, as set forth in claim 4, further including an electric motor and a drive operably connected to the cylindrical cam to rotate the cylindrical cam and the at least one cam follower.

6. The variable displacement hydraulic piston unit, as set forth in claim 1, including a hydraulic pump.

7. The variable displacement hydraulic piston unit, as set forth in claim 1, including a hydraulic motor.

8. A variable displacement hydraulic piston unit comprising:

a port plate including a flat surface having an axis therethrough and an intake port and an exhaust port at angularly spaced locations around the axis;

a cylinder barrel and structure supporting the cylinder barrel operative to rotate about the axis relative to the-port plate, the cylinder barrel having a first axial end portion in abutment with the surface of the port plate, an opposite second axial end portion, and a plurality of axial piston bores extending therethrough between the axial end portions in circumferentially spaced relation around the axis, the bores being positioned to sequentially open into the intake port and the exhaust port during the rotation of the cylinder barrel;

a plurality of pistons positioned for axial displacement in the respective piston bores in timed relation to the intake port and the exhaust port during the rotation of the cylinder barrel; and a swash plate and structure supporting the swash plate adjacent the second axial end portion of the cylinder barrel, the pistons being in sliding contact with the pistons during the rotation of the cylinder barrel, the structure supporting the swash plate including at electric motor operable to tilt the swash plate about a tilt axis oriented crosswise to the first named axis to vary the displacement of the pistons.

9. The variable displacement hydraulic piston unit, as set forth in claim 8, including structure to rotate the swash plate about the first named axis to vary the timed relation of the displacement of the pistons relative to the intake port and the exhaust port.

10. The variable displacement hydraulic piston unit, as set forth in claim 8, wherein the structure supporting the swash plate includes a cylindrical cam concentric with the first named axis and at least one cam follower cooperatively engaged with the cylindrical cam in supportive relation to the swash plate, the cylindrical cam and the at least one cam follower being relatively rotatable about the first named axis by the electric motor to tilt the swash plate about the tilt axis to vary the displacement of the pistons.

11. The variable displacement hydraulic piston unit, as set forth in claim 8, including a pump.

12. The variable displacement hydraulic piston unit, as set forth in claim 8, including a motor.

* * * * *